US011492751B2

(12) United States Patent
Spies

(10) Patent No.: US 11,492,751 B2
(45) **Date of Patent: *Nov. 8, 2022**

(54) RETAINING MEANS FOR PLASTIC FIBERS

(71) Applicant: Oliver Spies, Berlin (DE)

(72) Inventor: Oliver Spies, Berlin (DE)

( * ) Notice: Subject to any disclaimer, the term of this patent is extended or adjusted under 35 U.S.C. 154(b) by 203 days.

This patent is subject to a terminal disclaimer.

(21) Appl. No.: 17/076,352

(22) Filed: Oct. 21, 2020

(65) Prior Publication Data

US 2021/0032800 A1 Feb. 4, 2021

Related U.S. Application Data

(63) Continuation of application No. 16/032,613, filed on Jul. 11, 2018, now Pat. No. 10,851,492, which is a continuation of application No. PCT/EP2017/050690, filed on Jan. 13, 2017.

(30) Foreign Application Priority Data

Jan. 13, 2016 (DE) ..... 10 2016 100 493.6

(51) Int. Cl.
*D06F 95/00* (2006.01)
*D06F 35/00* (2006.01)

(52) U.S. Cl.
CPC ..... *D06F 95/006* (2013.01); *D06F 35/006* (2013.01); *D06F 95/008* (2013.01)

(58) Field of Classification Search
None
See application file for complete search history.

(56) References Cited

U.S. PATENT DOCUMENTS

| | | | |
|---|---|---|---|
| 3,769,819 | A | 11/1973 | Contreras |
| 4,630,312 | A | 12/1986 | Milstein |
| 2003/0059133 | A1 | 3/2003 | Hsieh |
| 2007/0261176 | A1 | 11/2007 | Stone |

FOREIGN PATENT DOCUMENTS

| | | | |
|---|---|---|---|
| DE | 84 04 746 | U1 | 5/1984 |
| DE | 201 04 636 | U1 | 7/2001 |
| DE | 100 14 996 | A1 | 10/2001 |

OTHER PUBLICATIONS

International Search Report issued for corresponding International Patent Application No. PCT/EP2017/050690 dated May 2, 2017.
English translation of the Written Opinion of the International Searching Authority issued for corresponding International Patent Application No. PCT/EP2017/050690 dated May 2, 2017.
Office Action issued by the German Patent Office for corresponding German Patent Application No. 10 2016 100 493.6, dated Sep. 22, 2016, with full, machine-generated English translation.
Notice of Acceptance issued for corresponding Australian Patent Application No. 2017207874 dated Apr. 26, 2019.
Communication for Intention to Grant issued for corresponding European Patent Application No. EP 17 701 283.8 dated Jun. 24, 2019 with an English translation.

*Primary Examiner* — Rita P Adhlakha
(74) *Attorney, Agent, or Firm* — Myers Wolin, LLC

(57) ABSTRACT

A retaining means is provided for retaining plastic fibers washed out of textiles during a washing process. The retaining means is designed as a laundry bag that holds at least one textile to be washed during a washing process and that can be closed in a suitable manner. The laundry bag is produced of a plastic woven screening fabric having an average mesh width in the range between 5 μm and 200 μm.

11 Claims, 3 Drawing Sheets

RETAINING MEANS FOR PLASTIC FIBERS

CROSS REFERENCE TO RELATED APPLICATIONS

This application is a continuation of U.S. patent application Ser. No. 16/032,613, filed Jul. 11, 2018, which is a continuation under 35 U.S.C. § 120 of International Application PCT/EP2017/050690, filed Jan. 13, 2017, which claims priority to German Application No. 10 2016 100 493.6, filed Jan. 13, 2016, the contents of each of which are incorporated by reference herein.

FIELD OF THE INVENTION

The present invention relates to a retaining means for holding back fibers washed out of textiles during a washing process and to a method for laundering textiles containing plastic fibers in an environmentally friendly manner.

BACKGROUND

Many of the textiles and clothing items sold nowadays, especially outdoor wear or other functional garments consisting of synthetic fibers comprising plastic fibers in a not unsubstantial proportion. These textiles have the disadvantage that plastic fibers or fragments of plastic fibers are washed or dissolved out while they are being laundered and are released together with the wastewater into the environment. Since the washed-out plastic fibers are quite generally very small and are short fibers or fiber fragments, conventional wastewater filters of washing machines are not capable of holding back the said fibers to a noteworthy extent. Sewage treatment plants are certainly able to hold back a certain proportion of the plastics found in wastewater, but as in the past they likewise still pass a large part of such fibers, which therefore contribute in a not inconsiderable extent to contamination of rivers and oceans, where they ultimately end up in the food chain again via the food intake of animals.

Obviously it is desirable that washing machines, sewage treatment plants, etc. be equipped with suitable microplastic filters, but obviously this is not yet comprehensively possible.

SUMMARY

An object of the present disclosure is therefore to provide a suitable retaining means of the type mentioned in the introduction, with which the wastewater burden during laundering of textiles containing plastic fibers can be greatly reduced.

This object may be achieved by a retaining means—configured as a washing bag. Preferred improvements will become apparent from the dependent claims and the description hereinafter.

The retaining means is configured as a washing bag that receives at least one textile to be washed during a washing process and that can be appropriately closed, wherein the washing bag is made of a thermoset plastic screen fabric with a mean mesh width in the range between 5 μm and 200 μm.

In this connection, it must be mentioned that consumers in particular are already familiar with the use of washing bags, although heretofore they have been used only as protection for special clothing items, for example, bras, which should increase the acceptance for use of washing bags.

Thus a "washing bag for laundering sensitive textile goods in the washing machine" is already known, for example, from German Utility Model DE 84 04 746.1. In the said utility model, it is mentioned that washing bags of "dense fabric" may also act as filters in a manner considered disadvantageous therein, in the sense that dirt particles dissolved from the textile materials to be washed cannot escape from the bag. What is not taught, however, is that or how such a filter effect can be used selectively for the purpose of environmental protection, since the nonwoven or dense fabric cited in DE 84 04 746.1 would in no case be suitable for the purpose of the present disclosure. Furthermore, according to DE 84 04 746.1, dense fabric would even hinder the access of active washing foam to the laundry items contained in the washing bag, thus disadvantageously influencing the washing result, which is why the washing bags mentioned therein ultimately are manufactured from a porous, perforated nonwoven, for example a spun-bonded nonwoven.

In contrast, the present retaining means provides the choice of a thermoset plastic screen fabric with a defined mean mesh width of between 5 and 200 μm as bag material for the washing bag functioning intentionally as plastic-fiber retaining means.

In contrast to the nonwoven fabric used for conventional washing bags, which certainly is not even suitable as a filter for holding back the microfibers in question here, a thermoset plastic screen fabric with defined mesh width is therefore used for the present purpose, so that a bag enclosing the laundry to be washed during the washing process can be used for protection of the environment, i.e. especially for reducing the wastewater burden due to plastic fibers.

Tests have shown that, with the retaining means in the form of a washing bag described herein, it is possible on the one hand to achieve a reliable retaining effect for the plastic fibers washed out of textiles with a retention percentage reaching almost 100%, while on the other hand a good washing result can be achieved. The use of a thermoset plastic screen fabric permits precise adjustment of the (mean) mesh widths according to the claims, which are suitable for effectively holding back the plastic fibers that would otherwise be released into the environment. A contribution to the effectiveness of the retaining means is the fact that an irregular alternation of external and internal water pressure acts on the washing bag during the washing process in a washing machine. Due to the particularly smooth surface of a thermoset plastic screen fabric, fiber fragments deposited on the inside face of the bag are flushed back by the incoming and outgoing water, whereby formation of a filter cake is prevented. This lowers the resulting dynamic pressure, keeps the bag material functioning as filter clean and ensures high filter efficiency. In contrast to this, conventional nonwoven fabric with undefined mesh width would become slowly clogged by the plastic fibers as they become deposited on and entangled with the fabric, thus disadvantageously influencing whatever filter effect that may exist.

In a preferred configuration, the mesh width of the fabric used for the washing bag lies in the range between 5 μm and 100 μm, especially approximately 50 μm, which optimizes the effectiveness of the intended filter action with simultaneous achievement of a good washing result.

For the plastic screen fabric to be used, it is preferable to use a thermoset polyamide, especially polyamide 6.6 (PA 6.6). Hereby it is possible in particular to achieve a continuous temperature resistance of 100° C. (wet), which is most suitable for the present purpose. Obviously it is also possible, however, within the scope of the present disclosure, to use other materials, provided they are sufficiently stable under the environmental conditions common for washing processes (especially in machines).

Furthermore, the use of a monofilament fabric, which incidentally can be used in a single sheet, is of advantage. It has proved particularly advantageous to use a single-sheet, monofilament screen fabric of PA 6.6 with a fabric thickness of approximately 80 μm, a mesh width of warp and weft of respectively 50 μm with a tolerance of only +/−10% and an open screen area of 27%.

Inasmuch as it was mentioned in the foregoing that the retaining means configured as a washing bag can be closed in suitable manner, the closure of the washing bag was obviously also intended to support the retaining function and thus be at least largely impenetrable for the plastic fibers in question with lengths on the order of 100 μm (or shorter).

To this extent, it is of advantage for the washing bag to be closable with a closure that likewise holds back the plastic fibers, especially with a zipper closure that is suitably fine (advantageously substantially watertight) and/or is covered if necessary by a layer of bag material. As a suitable closure, however, it is also possible to provide that an opening disposed along the hem of the washing bag is closed after introduction of the textile or textiles to be washed by rolling the washing bag inwardly in the region of its opening and then—especially by means of suitable closure elements (e.g. by means of press studs disposed in a reinforcement of the washing bag)—fixed in the inwardly rolled position. Hereby the bag material rolled inwardly in the region of the opening can prevent the plastic fibers to be held back from escaping out of the washing bag in the manner of a labyrinth seal.

The washing bag with retaining function for plastic fibers is advantageously matched in its dimensions to the size of the clothing items to be typically washed herewith, although it may also be adapted for use in laundries, for example, to receive several or even a large number of laundry items/textiles. Advantageously, the washing bag may even have the size of an entire laundry load for commercial washing machines.

It has proven particularly advantageous when a retaining means is offered in a set together with a clothing item made at least partly from plastic fibers (and possibly with washing instructions), in order to increase the willingness of the purchaser even more to wash the clothing item in question in the washing bag.

And, finally, the present disclosure also relates to a method for laundering textiles containing plastic fibers in an environmentally friendly manner, especially clothing items, comprising the following steps:

A) Stuffing at least one textile to be washed in a retaining means configured as a washing bag according to claim 1 and closing the washing bag B) Washing the retaining means and the textile(s) contained therein together, especially in a washing machine C) Removing the washed textile(s) and the held-back plastic fibers from the washing bag D) Disposing of the plastic fibers properly.

By virtue of the already described material properties, the removal of the plastic fibers accumulating in the washing bag is particularly simple. These merely have to be removed manually from the inside of the washing bag, just as consumers already know to do from the lint screen of their clothes dryer. Proper disposal of the plastic fibers held back in the bag may be accomplished, for example, via the household garbage.

BRIEF DESCRIPTION OF THE DRAWING

The invention will be explained in more detail hereinafter on the basis of the figures, wherein.

DETAILED DESCRIPTION OF THE PREFERRED EMBODIMENTS

Figure 1:
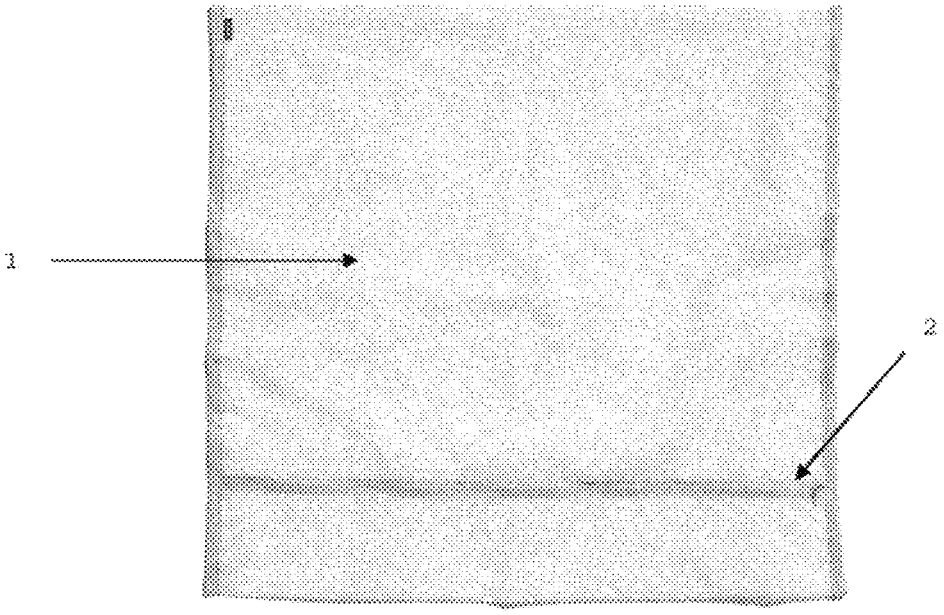
FIG. 1 shows an exemplary embodiment of an inventive retaining means.

FIG. 1 shows an exemplary embodiment of an inventive retaining means configured as a washing bag 1, which can be closed by means of a covered zipper closure 2. This washing bag 1 is made from two sheets of a thermoset plastic screen fabric of the type described in the foregoing, stitched together with one another along the hems and reinforced in the hem region.

Figure 2:
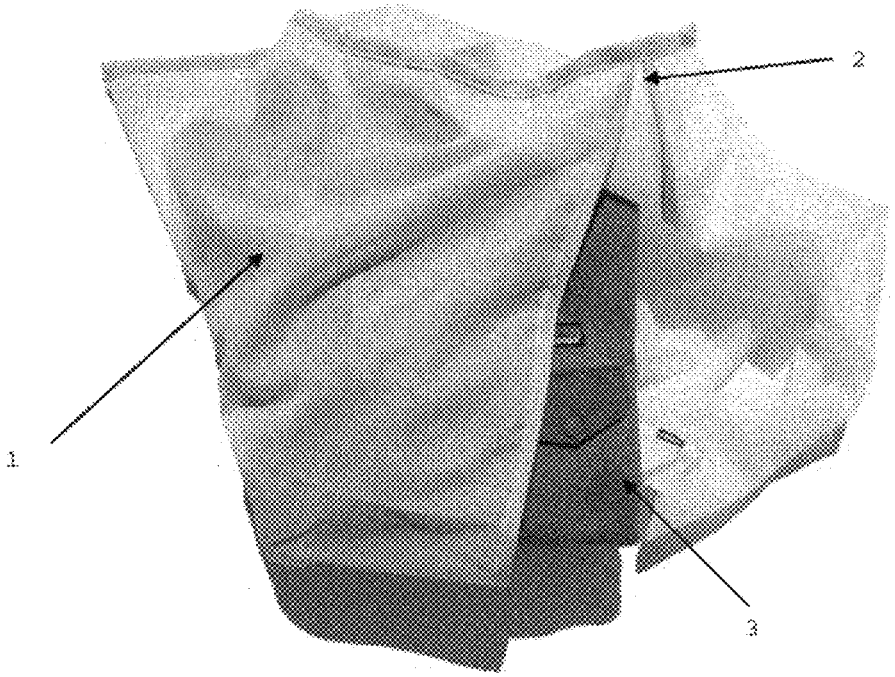
FIG. 2 shows the exemplary embodiment from FIG. 1, together with a clothing item to be stuffed into it.

FIG. 2 shows washing bag 1 from FIG. 1 with opened zipper closure 2, in which precisely one fleece pullover 3 to be washed is inserted. Now merely zipper closure 3 used as closure for washing bag 1 still has to be closed and then washing bag 1 together with fleece pullover 3 contained therein is washed in the usual way in a washing machine (not illustrated).

After completion of the washing process, fleece pullover 3 together with the plastic fibers that have been detached from clothing item 3 and held back in washing bag 1 is removed from washing bag 1 and the fibers are disposed of properly.

Figure 3:
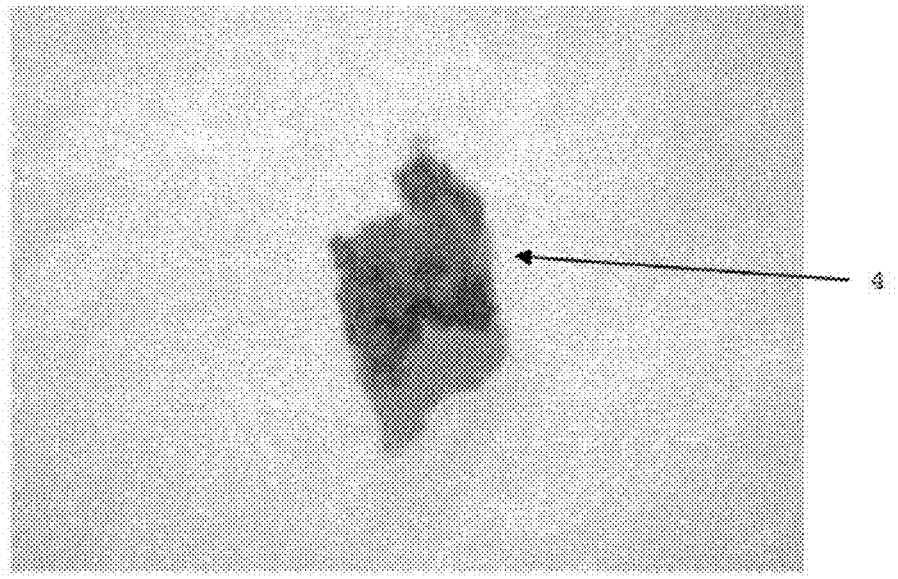
FIG. 3 shows the plastic fibers held back in a washing process.

Finally, FIG. 3 shows fibers 4 that were held back during a washing process and therefore, in an environmentally friendly manner, were not discharged with the wastewater of the washing machine into the environment.

Figure 4:
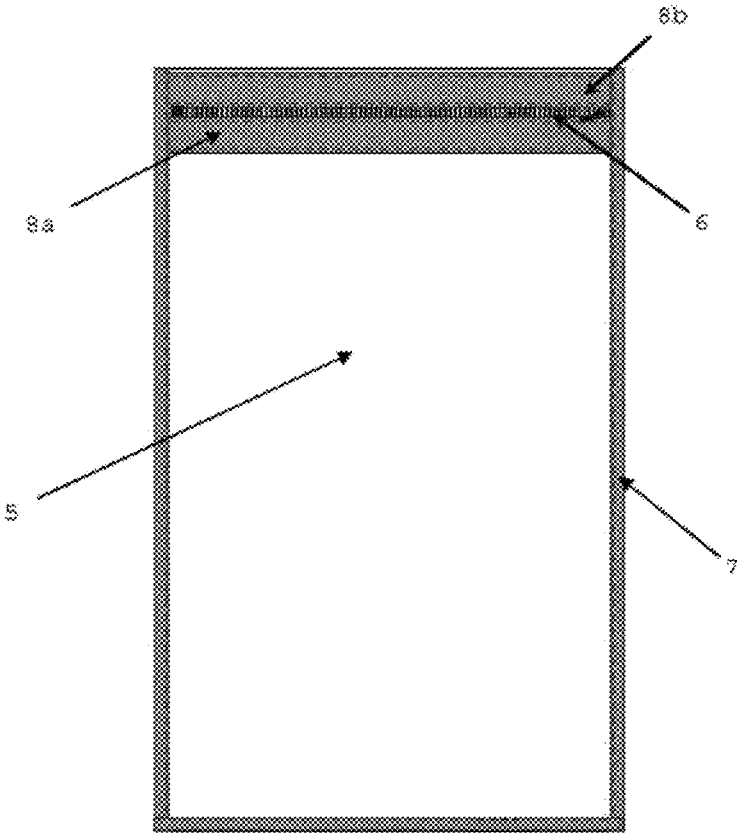
FIG. 4 shows a second exemplary embodiment of an inventive retaining means and FIGS. 5*a*-5*c* show three diagrams of the exemplary embodiment from FIG. 4 for illustration of the closure provided thereon.

FIG. 4 shows a further exemplary embodiment of an inventive retaining means configured as a washing bag 5. Washing bag 5 can likewise be closed by means of a zipper closure 6 and is again made from two sheets of a thermoset plastic screen fabric of the type described in the foregoing, stitched together with one another along the hems and reinforced in the hem region by means of a hem reinforcement 7. Zipper closure 6 of the closed washing bag 5 is close to the hem but set back somewhat from the hem, and it joins the two hems—facing one another—of two reinforcing tapes 8*a*, 8*b* extending over the entire width of washing bag 5.

In the frontal view shown in FIG. 4, this washing bag 5 preferably has a dimension of approx. 50×70 cm, although—as already described in the foregoing—it may also be made in other sizes suitable for laundering textiles.

Figure 5C:
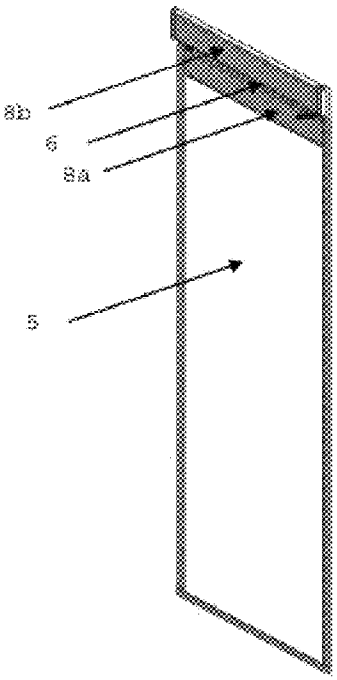
Figure 5B:
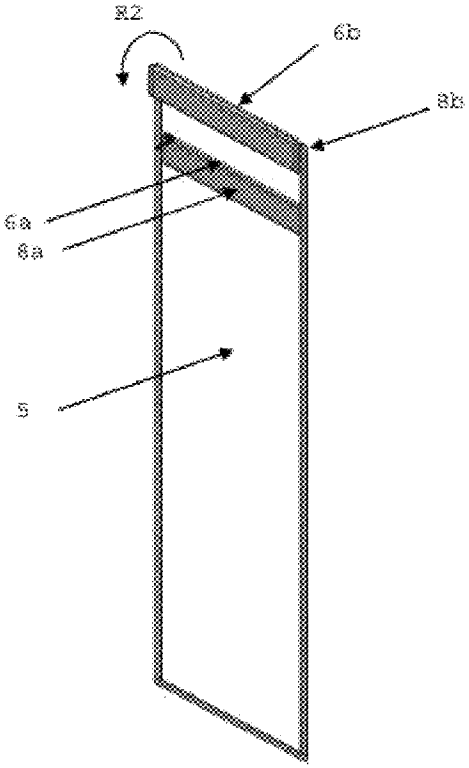
Figure 5A:
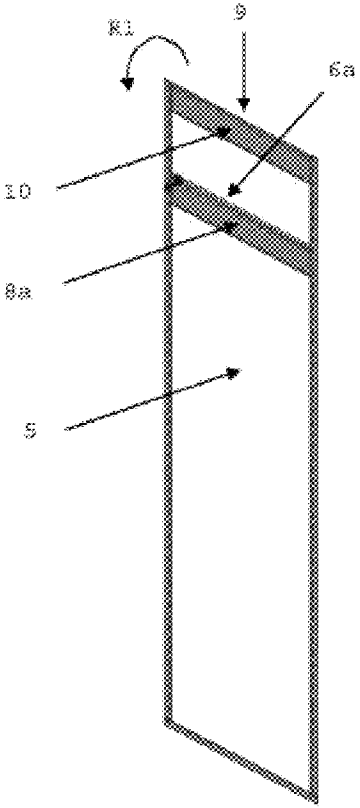

In FIGS. 5*a*, 5*b*, 5*c*, which illustrate the closing of washing bag 5 in a perspective view, the special nature of the closure used in this case is apparent.

FIG. 5*a* shows washing bag 5 while it still has not been closed at first. Along its top edge 9 illustrated in FIG. 5*a*, this has an opening, which extends along the hem and substantially over the entire width of washing bag 5 and through which the textiles to be washed can be stuffed simply into washing bag 5 and—after the washing process has taken place—can be simply removed from this again together with the fibers held back in washing bag 5.

Below top edge 9 and spaced apart from it, a first reinforcing tape 8*a*, along the top side of which a first part 6*a* of a zipper closure 6 is disposed, is provided on the outer front side of washing bag 5 illustrated in FIG. 5, in a manner extending crosswise over the width of washing bag 5. Beyond this, a further reinforcing tape 10 is provided—on front side and back side—along the hem of the washing bag surrounding the opening of the washing bag.

If washing bag 5 is now rolled inwardly by one first half turn in the direction of arrow R1 from FIG. 5*a* in the region of its opening (reinforced along the hem with reinforcing tape 10), then the washing bag assumes the position illustrated in FIG. 5*b*, in which it is already apparent that second part 6*b* of zipper closure 6 is disposed on a hem of reinforcing tape 10, now pointing upward, on the front side.

If washing bag 5 is now rolled inwardly by a further half turn in the direction of arrow R2 from FIG. 5*b*, then second part 6*b*, now pointing downward, of the zipper closure, and first part 6*a*, still pointing upward, of the zipper closure, are joined together with one another by closing the zipper closure in the usual way, whereby washing bag 5 is fixed in the inwardly rolled position.

Hereby, as already explained in the foregoing, a closure with a kind of labyrinth seal is provided in the washing bag for effectively holding back plastic fibers in the washing bag.

Within the scope of the present disclosure, it is obviously also possible to use, instead of zipper closure 6 joined together from two parts 6*a*, 6*b*, other suitable closure elements (such as, for example, press studs disposed on a reinforcement of the washing bag) for fixing the inwardly rolled washing bag in the region of the opening.

What is claimed is:

1. A retaining means for holding back plastic fibers washed out of textiles during a washing process, wherein the retaining means is configured as a washing bag that receives at least one textile to be washed during a washing process and that can be appropriately closed, wherein the washing bag is made of a plastic screen fabric with a mean mesh width in the range between 5 μm and 200 μm.

2. The retaining means of claim 1, wherein the mesh width lies in the range between 5 μm and 100 μm.

3. The retaining means of claim 1, wherein the plastic screen fabric is a thermoset polyamide, especially polyamide 6.6.

4. The retaining means of claim 1, wherein the screen fabric is a monofilament fabric.

5. The retaining means of claim 1, wherein the washing bag can be closed with a closure that holds back plastic fibers, especially with a zipper closure.

6. The retaining means of claim 1, wherein a closure is provided, in which an opening disposed along the hem of the washing bag is closed after introduction of the at least one textile to be washed by rolling the washing bag inwardly in the region of its opening, and is then fixed in the inwardly rolled position.

7. The retaining means of claim 6, wherein suitable closure elements are provided for fixing the washing bag in the inwardly rolled position.

8. The retaining means of claim 6, wherein the bag material rolled inwardly in the region of the opening prevents the plastic fibers to be held back from escaping out of the washing bag in the manner of a labyrinth seal.

9. The retaining means of claim 1, wherein the plastic screen fabric is a thermoset plastic screen fabric.

10. A set comprising a clothing item made at least partly from plastic fibers and a washing bag configured as the retaining means of claim 1.

11. A method for laundering textiles containing plastic fibers in an environmentally friendly manner, comprising the following steps:

A) stuffing at least one textile to be washed in a retaining means configured as a washing bag according to claim 1 and closing the washing bag;

B) washing the retaining means and the textile(s) contained therein together, especially in a washing machine;

C) removing the washed textile(s) and the held-back plastic fibers from the washing bag;

D) Disposing of the plastic fibers (4) properly.

* * * * *